US011728119B2

(12) United States Patent
Nakamura et al.

(10) Patent No.: US 11,728,119 B2
(45) Date of Patent: Aug. 15, 2023

(54) PHOTOCATHODE, AND METHOD FOR MANUFACTURING PHOTOCATHODE

(71) Applicants: NATIONAL UNIVERSITY CORPORATION SHIZUOKA UNIVERSITY, Shizuoka (JP); HAMAMATSU PHOTONICS K.K., Hamamatsu (JP)

(72) Inventors: Atsushi Nakamura, Hamamatsu (JP); Yusuke Noda, Hamamatsu (JP)

(73) Assignees: NATIONAL UNIVERSITY CORPORATION SHIZUOKA UNIVERSITY, Shizuoka (JP); HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/923,949

(22) PCT Filed: Apr. 15, 2021

(86) PCT No.: PCT/JP2021/015635
§ 371 (c)(1),
(2) Date: Nov. 8, 2022

(87) PCT Pub. No.: WO2021/235146
PCT Pub. Date: Nov. 25, 2021

(65) Prior Publication Data

US 2023/0187161 A1 Jun. 15, 2023

(30) Foreign Application Priority Data

May 20, 2020 (JP) ..... 2020-088003

(51) Int. Cl.
*H01J 43/08* (2006.01)
*H01J 1/34* (2006.01)
*H01J 9/12* (2006.01)

(52) U.S. Cl.
CPC ..... *H01J 1/34* (2013.01); *H01J 9/12* (2013.01); *H01J 43/08* (2013.01)

(58) Field of Classification Search
CPC ..... H01J 1/34; H01J 9/12
(Continued)

(56) References Cited

U.S. PATENT DOCUMENTS 6,298,179 B1 * 10/2001 Nishikawa ..... H01J 1/34 385/15
11,062,890 B1 * 7/2021 Yamaguchi ..... H01J 9/12
2023/0011913 A1 * 1/2023 Henriksen ..... H01L 29/66431

FOREIGN PATENT DOCUMENTS

CN 105514363 A 4/2016
JP 2001-202873 A 7/2001
(Continued)

OTHER PUBLICATIONS

International Preliminary Report on Patentability dated Dec. 1, 2022 in WO Patent Application No. PCT/JP2021/015635.

*Primary Examiner* — Christopher M Raabe
(74) *Attorney, Agent, or Firm* — Faegre Drinker Biddle & Reath LLP

(57) ABSTRACT

A photocathode 4 includes an optically transparent conductive layer provided between a translucent substrate and a photoelectric conversion layer. The optically transparent conductive layer is formed of a constituent material including carbon. A Raman spectrum of the constituent material has a peak of a band, a peak of a band, a peak of a band, and a peak of a band.

6 Claims, 8 Drawing Sheets

(58) Field of Classification Search
USPC ..... 313/542
See application file for complete search history.

(56) References Cited

FOREIGN PATENT DOCUMENTS

| | | | |
|---|---|---|---|
| JP | 2019-523522 | A | 8/2019 |
| WO | WO-2015/064173 | A1 | 5/2015 |
| WO | WO-2017/207898 | A2 | 12/2017 |

* cited by examiner (a)

(b)

(a)

(b)

PHOTOCATHODE, AND METHOD FOR MANUFACTURING PHOTOCATHODE

TECHNICAL FIELD

The present disclosure relates to a photocathode and a method for manufacturing a photocathode.

BACKGROUND ART

For example, a photocathode is constituted to include a photoelectric conversion layer on one surface side of a translucent substrate. In photocathodes, it is desired to perform linear detection covering a wide range from a very small quantity of light to a large quantity of light, that is, improve cathode linearity characteristics. Cathode linearity characteristics denote linearity when a cathode output current increases and decreases in proportion to increase and decrease of the quantity of incident light. In order to improve the cathode linearity characteristics, it is necessary to appropriately supply charges to a photoelectric conversion layer.

Regarding such technical problems, for example, a technique of providing an optically transparent conductive layer as a base between a translucent substrate and a photoelectric conversion layer to reduce a surface resistance of the photoelectric conversion layer has been researched. For example, in the photocathode described in Patent Literature 1, a constitution in which an intermediate layer made of graphite, carbon nanotubes, or the like is provided between a translucent substrate and a photoelectric conversion layer is disclosed.

CITATION LIST

Patent Literature

[Patent Literature 1] Japanese Unexamined Patent Publication No. 2001-202873

SUMMARY OF INVENTION

Technical Problem

Such a photocathode described above has diverse uses such as for a photoelectric tube, an image amplifier, a streak tube, and the like, in addition to a photomultiplier tube. Characteristics required for a photocathode vary widely in accordance with the use of an application target. For this reason, a technology in which a photocathode having desired characteristics can be easily obtained even when an optically transparent conductive layer is provided as a base between a translucent substrate and a photoelectric conversion layer has been desired.

The present disclosure has been made in order to solve the foregoing problems, and an object thereof is to provide a photocathode in which desired characteristics can be easily obtained even when an optically transparent conductive layer is provided as a base between a translucent substrate and a photoelectric conversion layer.

Solution to Problem

A photocathode according to an aspect of the present disclosure includes a translucent substrate having one surface on which light is incident and the other surface emitting the light incident through the one surface, a photoelectric conversion layer provided on the other surface of the translucent substrate and convert the light emitted through the other surface into photoelectrons, and an optically transparent conductive layer provided between the translucent substrate and the photoelectric conversion layer. The optically transparent conductive layer is formed of a constituent material including carbon. A Raman spectrum of the constituent material has a peak of a D1 band, a peak of a G band, a peak of a 2D1 band, and a peak of a (D1+G) band.

In this photocathode, the optically transparent conductive layer provided between the translucent substrate and the photoelectric conversion layer includes carbon as a constituent material, and the Raman spectrum of the constituent material has four peaks in the D1 band, the G band, the 2D1 band, and the (D1+G) band. In an optically transparent conductive layer formed of a constituent material having such a Raman spectrum, microscopically, it is conceivable that regions having different bonding states of carbon atoms are mixed so that optical transparency or an electrical resistance value varies depending on a disposition state of each region. Therefore, in this photocathode, optical transparency and electrical conductivity of the optically transparent conductive layer can be adjusted by adjusting the thickness of the optically transparent conductive layer, and thus desired characteristics can be easily obtained even when the optically transparent conductive layer is provided as a base between the translucent substrate and the photoelectric conversion layer.

A smallest value of a Raman intensity between the peak of the D1 band and the peak of the G band may be higher than a base value of a Raman intensity between the peak of the G band and the peak of the 2D1 band. In a photocathode including an optically transparent conductive layer having such a Raman spectrum, the foregoing constitution in which regions having different bonding states of carbon atoms are mixed can be more easily obtained, and adjustment of optical transparency and electrical conductivity is further facilitated.

A Raman intensity in the peak of the D1 band may be higher than a Raman intensity in the peak of the G band. In a photocathode including an optically transparent conductive layer having such a Raman spectrum, since the thickness of the optically transparent conductive layer is reduced, a photocathode having excellent optical transparency can be obtained.

A Raman intensity in the peak of the D1 band may be lower than the Raman intensity in the peak of the G band. In a photocathode including an optically transparent conductive layer having such a Raman spectrum, since the thickness of the optically transparent conductive layer is increased, adjustment of optical transparency and electrical conductivity is further facilitated.

A method for manufacturing a photocathode according to another aspect of the present disclosure is a method for manufacturing a photocathode, in which the foregoing photocathode is manufactured. The method for manufacturing a photocathode includes a step of disposing a translucent substrate inside a vapor deposition device, a step of forming an optically transparent conductive layer by introducing gas including carbon into the vapor deposition device and performing vapor deposition of a constituent material including carbon on the translucent substrate, and a step of forming a photoelectric conversion layer on the optically transparent conductive layer.

In this method for manufacturing a photocathode, an optically transparent conductive layer is formed on a translucent substrate through vapor deposition using gas including carbon. According to such a technique, in contrast to a technique in which a separately formed optically transparent conductive layer is transferred onto the translucent substrate, an optically transparent conductive layer can be easily formed through a step of simply performing vapor deposition using the vapor deposition device. In addition, the thickness of the optically transparent conductive layer can be easily adjusted by adjusting a vapor deposition time using the vapor deposition device, and thus desired characteristics can be easily obtained even when an optically transparent conductive layer is provided as a base between a translucent substrate and a photoelectric conversion layer.

A vapor deposition time for the constituent material may be 60 minutes or shorter. In this case, an optically transparent conductive layer having each of the peaks as described above can be favorably obtained.

Advantageous Effects of Invention

According to the present disclosure, it is possible to easily obtain desired characteristics even when an optically transparent conductive layer is provided as a base between a translucent substrate and a photoelectric conversion layer.

DESCRIPTION OF EMBODIMENTS

Hereinafter, with reference to the drawings, preferred embodiments of a photocathode and a method for manufacturing a photocathode according to aspects of the present disclosure will be described in detail.

[Constitution of Photomultiplier Tube]

Figure 1:
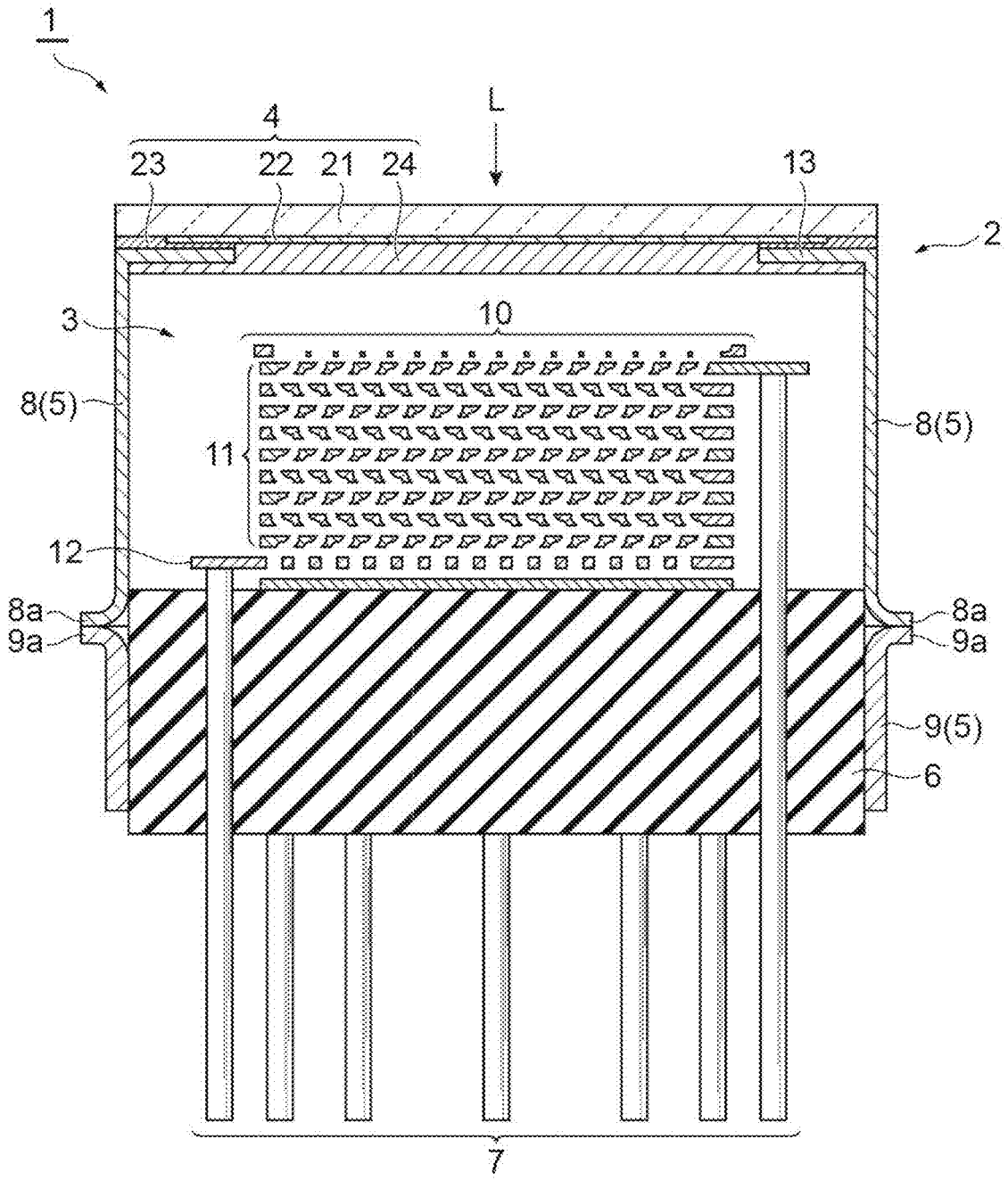
FIG. 1 is a cross-sectional view illustrating an example of a photomultiplier tube using a photocathode according to an embodiment of the present disclosure.

FIG. 1 is a cross-sectional view illustrating a photomultiplier tube 1 using a photocathode 4 according to an embodiment of the present disclosure. The photomultiplier tube 1 illustrated in FIG. 1 is a detector for detecting incident light L with high sensitivity by amplifying photoelectrons generated due to a photoelectric effect. As illustrated in the same diagram, the photomultiplier tube 1 is constituted to store an electron multiplier portion 3 inside a substantially cylindrical casing 2 which is a vacuum container. The casing 2 is constituted to include the photocathode 4 which performs photoelectric conversion of the incident light L, a side tube portion 5 which is made of a metal and holds the photocathode 4 on one end side, and a stein 6 which is made using an insulating member and seals the other end side of the side tube portion 5. A plurality of stein pins 7 which are inserted and attached with respect to the stein 6 protrude from the other end side of the side tube portion 5.

The photocathode 4 is a part performing photoelectric conversion of the incident light L due to a photoelectric effect and discharges photoelectrons toward the electron multiplier portion 3. The photocathode 4 is constituted to include a translucent substrate 21, a photoelectric conversion layer 24, and an optically transparent conductive layer 22 therebetween. For example, the photocathode 4 is joined to the side tube portion 5 by means of a joint member 23. However, regarding the photoelectric conversion layer 24, it is also formed on a part of an inner wall surface of the side tube portion 5. Details of the photocathode 4 will be described below.

The side tube portion 5 includes a first side tube portion 8 which mainly covers the electron multiplier portion 3 and a second side tube portion 9 which mainly covers the stein 6. An outward flange portion 8*a* is provided at a base end of the first side tube portion 8, and an inward flange portion 13 is provided at a tip of the first side tube portion 8. An outward flange portion 9*a* having the same diameter as a flange portion 8*a* is provided in the second side tube portion 9. The first side tube portion 8 and the second side tube portion 9 are firmly bonded to each other by airtightly joining the flange portions 8*a* and 9*a* to each other.

The electron multiplier portion 3 has a focusing electrode 10, dynodes 11, and an anode 12. The focusing electrode 10 is a flat plate-shaped electrode which is disposed between the photocathode 4 and the dynodes 11, focuses photoelectrons discharged from the photocathode 4 on the dynodes 11, and introduces the focused photoelectrons. The dynodes 11 are thin plate-shaped electrodes which have many electron multiplier holes and are disposed in a plurality of stages from the photocathode 4 side to the stein 6 side. The anode 12 is a flat plate-shaped electrode which takes out electrons multiplied by the electron multiplier portion 3 as an output signal. For example, the anode 12 is disposed in a stage one before the dynode 11 in the last stage.

When a predetermined voltage is applied to the electron multiplier portion 3 and the anode 12 via the stein pins 7, the photoelectric conversion layer 24 and the focusing electrode 10 have the same potential, and the potential in each stage of the dynodes 11 gradually increases from the photocathode 4 side toward the stein 6 side. When the incident light L is incident on the photoelectric conversion layer 24 from the translucent substrate 21 in this state, the incident light L is subjected to photoelectric conversion, and photoelectrons are discharged into the casing 2. Discharged photoelectrons are focused on the dynode 11 in the first stage by the focusing electrode 10 and are sequentially subjected to secondary electron multiplication by the dynodes 11 in each stage thereafter. A secondary electron group is discharged from the dynode 11 in the last stage. The secondary electron group is guided to the anode 12 and is output to the outside via the stein pins 7 (anode pins) connected to the anode 12.

In the embodiment, the photomultiplier tube 1 to which the photocathode 4 is applied has been described as an example, but the photocathode according to the present disclosure is not limited to a photomultiplier tube, which may be replaced by other electron tubes such as a photoelectric tube, an image amplifier, and a streak tube.

[Constitution of Photocathode]

Figure 2:
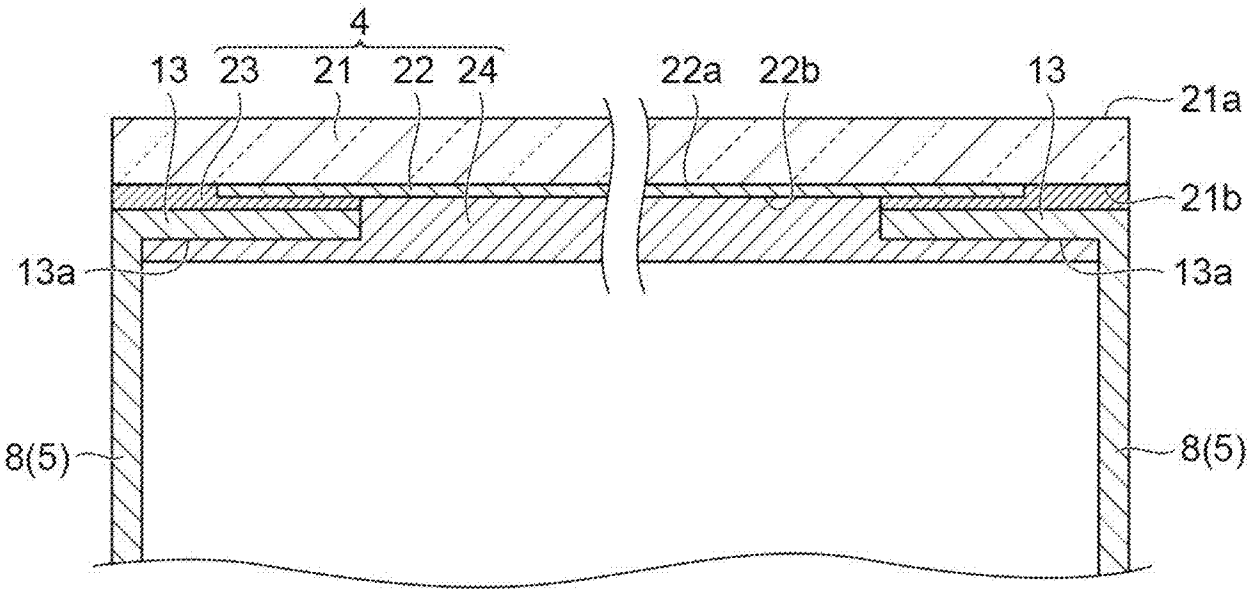
FIG. 2 is an enlarged cross-sectional view of a main part of the photomultiplier tube illustrated in FIG. 1.

FIG. 2 is an enlarged cross-sectional view of a main part of the photomultiplier tube 1 illustrated in FIG. 1. As illustrated in FIG. 2, the photocathode 4 is constituted to include the translucent substrate 21, the optically transparent conductive layer 22, the joint member 23, and the photoelectric conversion layer 24.

For example, the translucent substrate 21 is formed of a glass material such as quartz glass or a crystalline material such as $MgF_2$ into a disk shape and causes the incident light L to be incident inside the casing 2. The translucent substrate 21 has one surface 21*a* on which the incident light L is incident, and the other surface 21*b* which faces the one surface 21*a* and emits the incident light L toward the electron multiplier portion 3. The translucent substrate 21 is airtightly fixed to the inward flange portion 13 provided at the end of the side tube portion 5 by means of the joint member 23 on an outer surface side of the casing 2.

The optically transparent conductive layer 22 is a base layer of the photoelectric conversion layer 24 with respect to the translucent substrate 21 and is formed of a constituent material C including carbon (refer to FIG. 3) into a circular shape. This optically transparent conductive layer 22 allows the incident light L to be transmitted therethrough toward the photoelectric conversion layer 24 and reduces a surface resistance of the photoelectric conversion layer 24. The optically transparent conductive layer 22 has one surface 22*a* which comes into contact with the translucent substrate 21, and the other surface 22*b* which comes into contact with the photoelectric conversion layer 24. The optically transparent conductive layer 22 is formed to have a circular shape having a diameter larger than an inner diameter of the inward flange portion 13 (that is, to have a size covering an opening portion formed by a flange portion 13) by performing vapor deposition of the constituent material C including carbon on the other surface 21*b* of the translucent substrate 21.

For example, the joint member 23 is made of an electrically conductive material such as aluminum. The joint member 23 is disposed such that a gap between a circumferential edge portion of the translucent substrate 21 and a circumferential edge portion of the optically transparent conductive layer 22, and the flange portion 13 is filled therewith. The joint member 23 serves as a practical fixing member with respect to the side tube portion 5 of the photocathode 4 and electrically connects the optically transparent conductive layer 22 to the side tube portion 5.

For example, the photoelectric conversion layer 24 is a multi-alkali photoelectric surface having a sensitivity to an infrared region. For example, the photoelectric conversion layer 24 is constituted to contain antimony (Sb), potassium (K), cesium (Cs), and the like. The photoelectric conversion layer 24 converts the incident light L which has been incident thereon through the translucent substrate 21 and the optically transparent conductive layer 22 into photoelectrons and emits converted photoelectrons toward the electron multiplier portion 3. The photoelectric conversion layer 24 is provided to cover an inner surface 13*a* of the flange portion 13 and a region exposed from the flange portion 13 on the other surface 22*b* of the optically transparent conductive layer 22 and to come into contact with inner circumferential edge portions of the joint member 23 and the flange portion 13.

[Constitution of Optically Transparent Conductive Layer]

Next, the foregoing optically transparent conductive layer 22 will be described in more detail.

Figure 3:
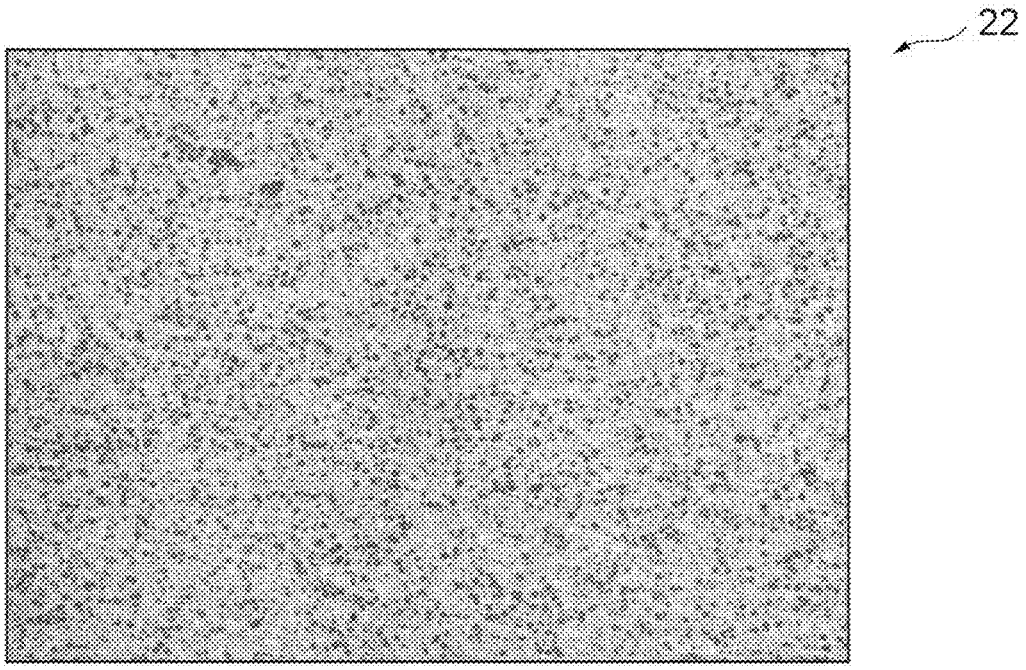
FIG. 3(*a*) is a view illustrating an example of a constituent material of an optically transparent conductive layer, and FIG. 3(*b*) is an enlarged view of a main part of FIG. 3(*a*).
Figure 3:
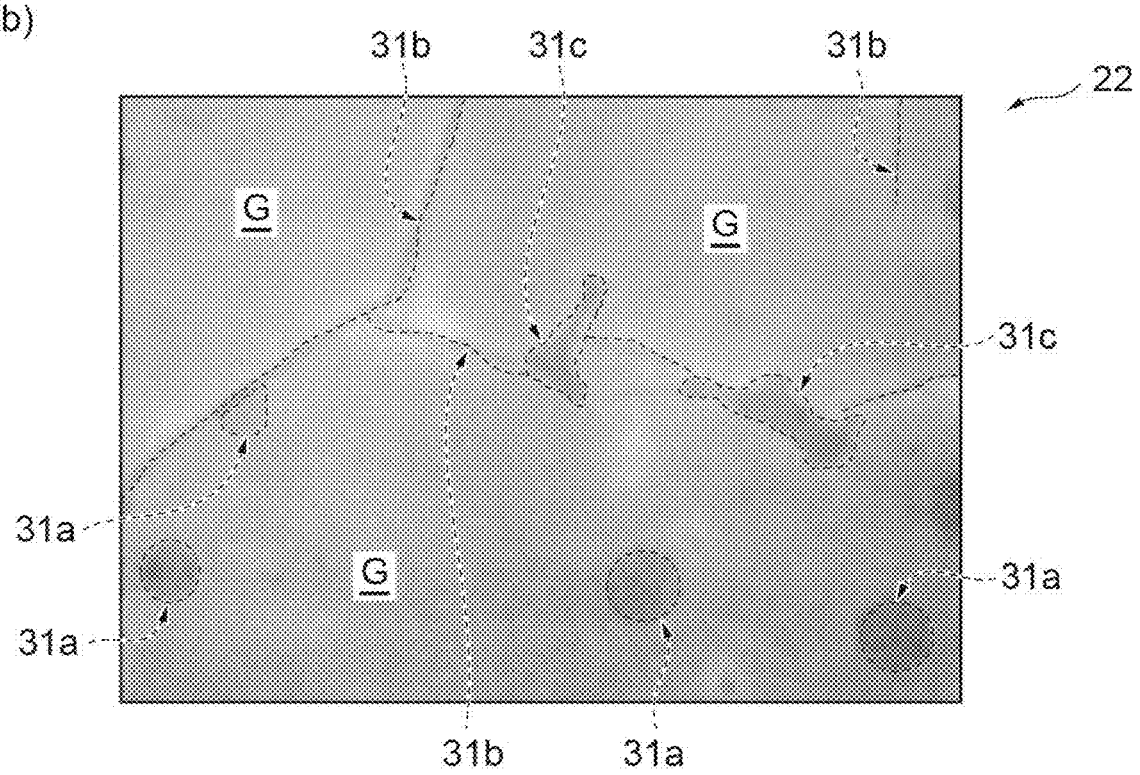

FIG. 3(*a*) is a view illustrating an example of a constituent material of an optically transparent conductive layer, and FIG. 3(*b*) is an enlarged view of a main part of FIG. 3(*a*). Both FIGS. 3(*a*) and 3(*b*) are observation results of the optically transparent conductive layer 22 using a scanning electron microscope. FIG. 3(*a*) is an image when the magnification is set to 10,000 times, and FIG. 3(*b*) is an image when the magnification is set to 50,000 times. In the optically transparent conductive layer 22, as illustrated in FIG. 3(*b*), microscopically, graphite-like two-dimensional layer-shaped films are formed of the constituent material C including carbon with boundaries. Since these two-dimensional layer-shaped films have optical transparency and electrical conductivity, two-dimensional layer-shaped films adjacent to each other are electrically connected to each other, and thus optical transparency and electrical conductivity for the optically transparent conductive layer 22 are ensured. In the following description, such basic structure regions will be referred to as regions G.

In the optically transparent conductive layer 22, in addition to the regions G, as deformation regions 31, block-shaped parts 31*a* in which graphene structures remain, layer-shaped film structure flake boundaries 31*b*, opening parts 31*c* which are not covered by the constituent material C and through which the translucent substrate 21 is exposed, and the like are randomly present. In the block-shaped parts 31*a*, for example, graphene structures are present as certain blocks. In the layer-shaped film structure flake boundaries 31*b* which are discontinuous parts, for example, defects are formed due to torsion or segmentation of carbon bonding, and the opening parts 31*c* are formed due to torsion or segmentation thereof. The incident light L is transmitted mainly through the regions G and the opening parts 31*c*. In the present embodiment, particularly, optical transparency can be remarkably improved by including the opening parts 31*c* which have not been present in graphene structures in the related art. In the following description, for the sake convenience, a substance in the foregoing state will be referred to as "glassy carbon".

In the present embodiment, the optically transparent conductive layer 22 is formed in the translucent substrate 21 by performing vapor deposition of glassy carbon in the translucent substrate 21 using a carbon supply material. For example, a vapor deposition time for glassy carbon is 60 minutes or shorter. The vapor deposition time for glassy carbon may be 30 minutes or shorter or may be 10 minutes or shorter. Generally, more opening parts 31*c* are observed as the vapor deposition time becomes shorter, and the surface area of the presence of the opening parts 31*c* also tends to increase. In this case, optical transparency is improved, and electrical conductivity is degraded. On the other hand, when the vapor deposition time becomes longer and growth of the two-dimensional layer-shaped films proceeds, the number of opening parts 31*c* decreases, and the surface area of the presence of the opening parts 31*c* tends to decrease. In this case, optical transparency is degraded, and electrical conductivity is improved. The states of the optically transparent conductive layer 22 illustrated in FIGS. 3(*a*) and 3(*b*) are merely examples, and it is possible to obtain the optically transparent conductive layer 22 having desired optical transparency and electrical conductivity by suitably adjusting the vapor deposition time.

In addition, the surface area of the presence of the regions G within a plane when the optically transparent conductive layer 22 is viewed in a thickness direction (a direction in which the one surface 22*a* and the other surface 22*b* are connected to each other) increases as the thickness of the optically transparent conductive layer 22 increases, and it decreases as the thickness of the optically transparent conductive layer 22 decreases. This denotes that the surface area of the presence of the opening parts 31*c* within a plane when the optically transparent conductive layer 22 is viewed in the thickness direction increases as the thickness of the optically transparent conductive layer 22 decreases, and it decreases as the thickness of the optically transparent conductive layer 22 increases. Therefore, it is ascertained that electrical conductivity and optical transparency have a trade-off relationship with respect to the thickness of the optically transparent conductive layer 22. As the thickness of the optically transparent conductive layer 22 increases, electrical conductivity of the optically transparent conductive layer 22 increases and optical transparency thereof decreases, and as the thickness of the optically transparent conductive layer 22 decreases, electrical conductivity of the optically transparent conductive layer 22 decreases and optical transparency thereof increases.

Figure 4:
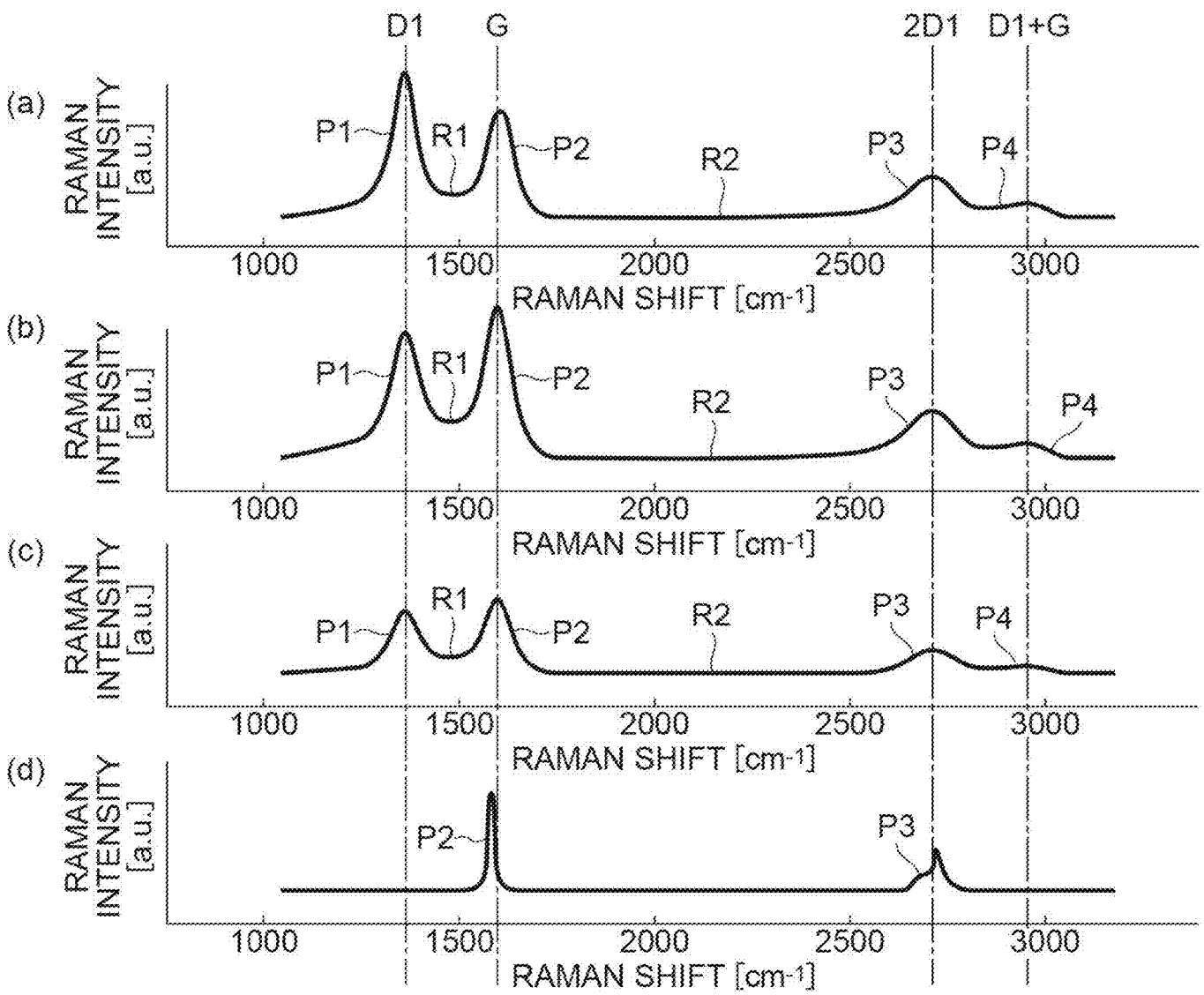
FIGS. 4(*a*) to 4(*d*) are views illustrating examples of Raman spectra of glassy carbon constituting an optically transparent conductive layer.

FIG. 4 is a view illustrating examples of Raman spectra of glassy carbon constituting the optically transparent conductive layer 22. In FIG. 4, the horizontal axis indicates a Raman shift ($cm^{-1}$), and the vertical axis indicates a Raman intensity (a.u.). FIGS. 4(*a*) to 4(*c*) illustrate Raman spectra of glassy carbon having different vapor deposition times, and FIG. 4(*d*) illustrates a Raman spectrum of highly oriented pyrolytic graphite (HOPG) as a comparative example. In the cases of FIGS. 4(*a*) to 4(*c*), the vapor deposition times are 10 minutes, 30 minutes, and 60 minutes, respectively.

A Raman spectrum is a spectrum obtained by Raman spectroscopy, electron energy loss spectroscopy, or the like and is used for state analysis of a substance. A peak intensity of a Raman spectrum is an index for expressing polarizability and a state of orientation, and wave number information is an index for expressing a composition. In addition, a peak ratio is an index for expressing a relative ratio of each substance, a full width at half maximum of a peak is an index for expressing crystallinity or a defect/dope, and a peak shift is an index for expressing distortion, stress, a temperature, or the like.

FIG. 4 illustrates four bands including a D1 band, a G band, a 2D1 band, and a (D1+G) band. The D1 band is a band indicating a disorder or a defect of the structures. A peak P1 of the D1 band is caused by a lattice motion in a direction of separation from the center of a Brillouin zone. When the peak P1 of the D1 band is present, it indicates that a defect, an edge part, or the like is included in a substance. The G band is a band derived from an in-plane motion of atoms. A peak P2 of the G band changes due to an influence of distortion of the structures and is also used as an index for indicating the number of layers. The peak P2 of the G band tends to be extremely sharp and strong in a single layer and tends to be broadened in accordance with increase in the number of layers.

The 2D1 band is a band derived from double scattering of a six-membered ring. A peak P3 of the 2D1 band corresponds to a 2 harmonic overtone of the D1 band and has strong frequency dependence with respect to excitation light as a result of a double resonance process in which a wave number vector of a phonon and an electron band structure are associated with each other. Similar to the peak P2 of the G band, the peak P3 of the 2D1 band tends to be broadened in accordance with increase in the number of layers. The (D1+G) band is a band derived from double scattering of the D1 band and the G band. A peak P4 of the (D1+G) band is positioned on a higher wave number side than the peak P3 of the 2D1 band and tends to be broadened in accordance with increase in the number of layers.

A range of presence of the peak in each band depends on an excitation wavelength of the Raman spectrum. For example, the D1 band is positioned within a range of 1,580 to 1,600 $cm^{-1}$, and the G band is positioned within a range of 1,580 to 1,600 $cm^{-1}$. For example, the 2D1 band is positioned within a range of 2,700 to 2,750 $cm^{-1}$, and the (D1+G) band is positioned within a range of 2,930 to 3,000 $cm^{-1}$. In the example of FIG. 4, the excitation wavelength of the Raman spectrum is 457 nm, and the wave number of the peak P1 of the D1 band is approximately 1,360 $cm^{-1}$. In addition, the wave number of the peak P2 of the G band is approximately 1,580 $cm^{-1}$, the wave number of the peak P3 of the D2 band is approximately 2,700 $cm^{-1}$, and the wave number of the peak P4 of the (D1+G) band is approximately 2,930 $cm^{-1}$.

As illustrated in FIGS. 4(*a*) to 4(*c*), all of the Raman spectra of glassy carbon have four peaks including the peak P1 of the D1 band, the peak P2 of the G band, the peak P3 of the 2D1 band, and the peak P4 of the (D1+G) band. On the other hand, as illustrated in FIG. 4(*d*), the Raman spectra of highly oriented pyrolytic graphite (HOPG) do not have the peak P1 of the D1 band and the peak P4 of the (D1+G) band and have only two peaks, that is, the peak P2 of the G band and the peak P3 of the 2D1 band.

In the Raman spectra of glassy carbon, the peak P1 of the D1 band and the peak P2 of the G band appear more prominently than the peak P3 of the 2D1 band and the peak P4 of the (D1+G) band. As the vapor deposition time for forming glassy carbon becomes longer (the thickness of the optically transparent conductive layer 22 increases), the magnitude relationship between the peak intensity of the peak P1 of the D1 band and the peak intensity of the peak P2 of the G band gradually changes.

In the example of FIG. 4, when the vapor deposition time is 10 minutes, the peak intensity of the peak P1 of the D1 band is higher than the peak intensity of the peak P2 of the G band. In contrast, when the vapor deposition time is 30 minutes and 60 minutes, the peak intensity of the peak P2 of the G band is higher than the peak intensity of the peak P1 of the D1 band. From this, it is ascertained that when the vapor deposition time is short, glassy carbon is constituted to include plenty of relatively small crystal having many defects, and when the vapor deposition time becomes longer, the structure of glassy carbon is polycrystallized and gradually resembles a graphene structure.

The peak P3 of the 2D1 band and the peak P4 of the (D1+G) band are gradually broadened as the vapor deposition time for forming glassy carbon becomes longer, and the peak intensities thereof are also gradually degraded. The magnitude relationship between the peak intensity of the peak P3 of the 2D1 band and, the peak intensity of the peak P4 of the (D1+G) band does not change regardless of the vapor deposition time. In the example of FIG. 4, in any case in which the vapor deposition time is 10 minutes, 30 minutes, and 60 minutes, the peak intensity of the peak P3 of the 2D1 band remains higher than the peak intensity of the peak P4 of the (D1+G) band.

In addition, as illustrated in FIGS. 4(*a*) to 4(*c*), in the Raman spectra of glassy carbon, a hem part of the peak P1 of the D1 band and a hem part of the peak P2 of the G band are in a state of overlapping each other. Accordingly, a smallest value R1 of the Raman intensity between the peak P1 of the D1 band and the peak P2 of the G band is larger than a base value R2 of the Raman intensity between the peak P2 of the G band and the peak P3 of the 2D1 band. Regarding the base value R2, an average value of the Raman intensities in sections in which the spectrum becomes flat between the peak P2 of the G band and the peak P3 of the 2D1 band may be used or a largest value of the Raman intensity in the same sections may be used.

[Method for Manufacturing Photocathode]

Figure 5:
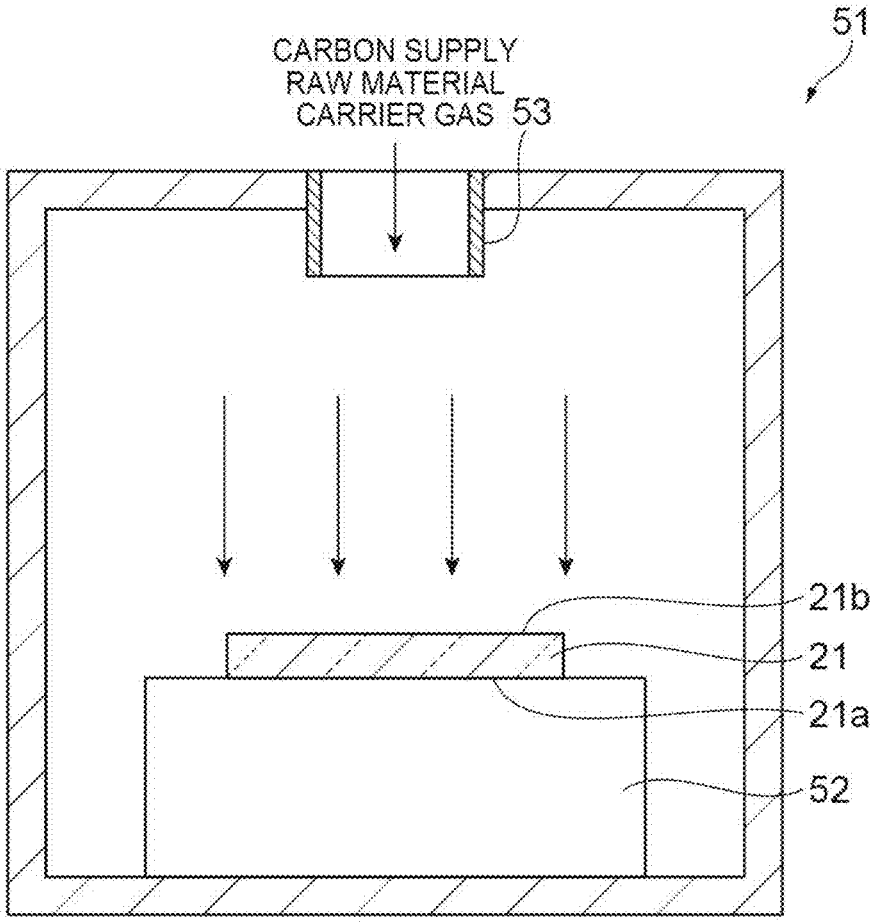
FIGS. 5(*a*) and 5(*b*) are cross-sectional views illustrating a method for manufacturing a photocathode according to the embodiment of the present disclosure.
Figure 5:
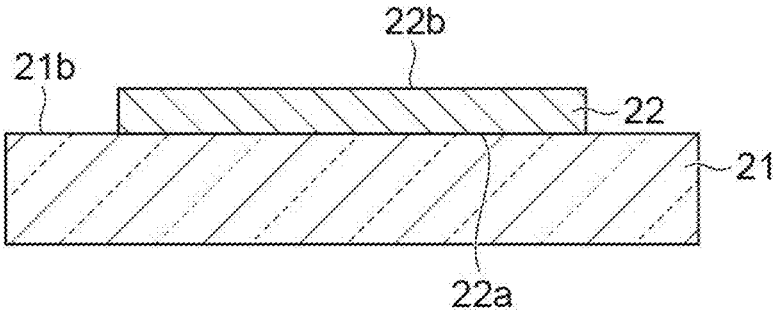

When the photocathode 4 having the constitution described above is manufactured, first, the translucent substrate 21 is prepared. For example, the translucent substrate 21 is washed using acetone and ethanol and is rinsed with water thereafter. Next, as illustrated in FIG. 5(*a*), the translucent substrate 21 is placed on a stage 52 inside a vapor deposition device 51 such that the other surface 21*b* of the translucent substrate 21 is directed upward. After the translucent substrate 21 is placed, the inside of the vapor deposition device 51 is decompressed to approximately 0.01 Torr. For example, ethanol vapor can be used as a carbon supply raw material, and for example, argon gas can be used as carrier gas.

Subsequently, carrier gas is introduced into the vapor deposition device 51 at a flow rate of approximately 180 sccm, the pressure is raised to approximately 10 Torr, and the temperature is raised to approximately 1,000° C. After the pressure and the temperature inside the vapor deposition device 51 are made stable, a carbon supply raw material which is a basic material of the constituent material C is introduced into the vapor deposition device 51 through a shower head 53 at a flow rate of approximately 1 sccm. Thereafter, the carbon supply raw material is kept on being supplied for approximately 10 minutes to 60 minutes, and glassy carbon is caused to grow on the other surface 21*b* of the translucent substrate 21 with a desired thickness. After glassy carbon having a desired thickness is caused to grow, supply of a carbon supply raw material is stopped, and the glassy carbon is cooled to room temperature by natural cooling. Accordingly, the optically transparent conductive layer 22 is formed on the other surface 21*b* of the translucent substrate 21.

Next, the translucent substrate 21 having the optically transparent conductive layer 22 formed therein is taken out from the vapor deposition device 51, and the optically transparent conductive layer 22 in the circumferential edge portion on the other surface 21*b* of the translucent substrate 21 is selectively removed. When the optically transparent conductive layer 22 is removed, for example, plasma irradiation of the optically transparent conductive layer 22 is performed in a state in which a circular mask having a smaller diameter than the translucent substrate 21 is disposed in a central part of the optically transparent conductive layer 22. Accordingly, in the optically transparent conductive layer 22, parts exposed through the mask are removed. As illustrated in FIG. 5(*b*), the optically transparent conductive layer 22 having a smaller diameter than the translucent substrate 21 is coaxially formed on the other surface 21*b* of the translucent substrate 21.

Figure 6:
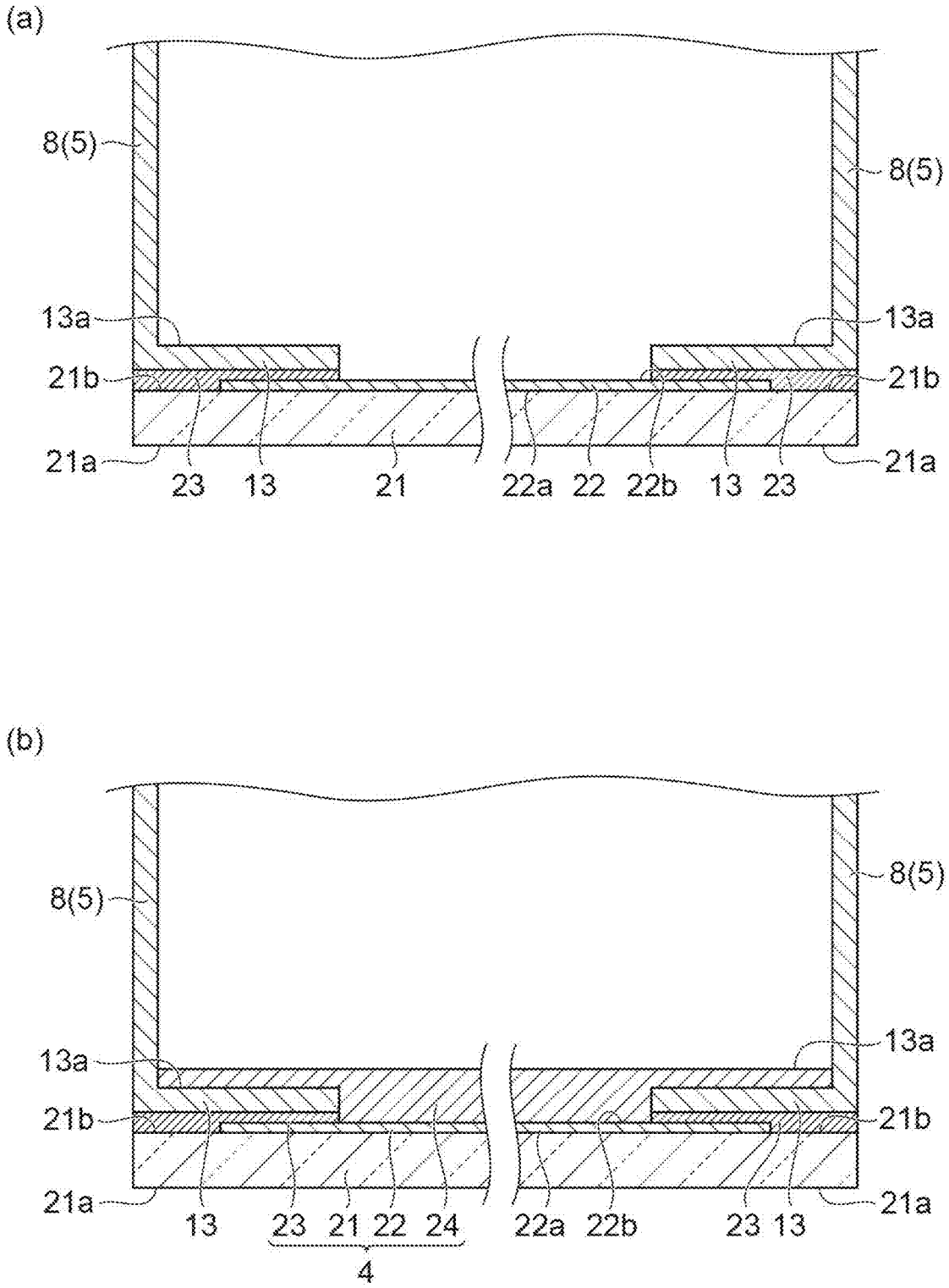
FIGS. 6(*a*) and 6(*b*) are cross-sectional views illustrating a step subsequent to that of FIG. 5.

Subsequently, as illustrated in FIG. 6(*a*), the flange portion 13 is disposed such that it overlaps the circumferential edge portion of the optically transparent conductive layer 22 and airtightly joins the other surface 21*b* of the translucent substrate 21 and the flange portion 13 to each other by means of the joint member 23.

In addition, on the inner surface 13*a* of the flange portion 13 and the other surface 22*b* of the optically transparent conductive layer 22, antimony is subjected to vapor deposition with respect to each of regions exposed through the flange portion 13, the joint member 23, and the inner circumferential edge portion of the flange portion 13. Thereafter, as illustrated in FIG. 6(*b*), a bialkali photoelectric surface (photoelectric conversion layer 24) is formed on the other surface 22*b* of the optically transparent conductive layer 22 as a base layer by causing potassium and cesium to react the antimony using a transfer device. Through the steps described above, the foregoing photocathode 4 illustrated in FIGS. 1 and 2 can be obtained. The other surface 21*b* of the translucent substrate 21 may be airtightly fixed to the flange portion 13 in advance, and the optically transparent conductive layer 22 may be formed on the other surface 21*b* of the translucent substrate 21 thereafter.

[Operational Effects]

As described above, in the photocathode 4, the optically transparent conductive layer 22 provided between the translucent substrate 21 and the photoelectric conversion layer 24 includes carbon as the constituent material C, and the Raman spectrum of the constituent material C has four peaks in the D1 band, the G band, the 2D1 band, and the (D1+G) band. In the optically transparent conductive layer 22 formed of the constituent material C having such a Raman spectrum, microscopically, for example, it is conceivable that the block-shaped parts 31*a* in which the lattice structure of carbon atoms is retained, the layer-shaped film structure flake boundaries 31*b* in which the lattice structure of carbon atoms has a defect such as torsion or segmentation, and the like are mixed, and optical transparency or an electrical resistance value varies due to the state in which each of the deformation regions 31 is disposed. Therefore, in this photocathode 4, optical transparency and electrical conductivity of the optically transparent conductive layer 22 can be adjusted by adjusting the thickness of the optically transparent conductive layer 22, and even when the optically transparent conductive layer 22 is provided as a base between the translucent substrate 21 and the photoelectric conversion layer 24, desired characteristics can be easily obtained.

In the present embodiment, the smallest value R1 of the Raman intensity between the peak P1 of the D1 band and the peak P2 of the G band is larger than the base value R2 of the Raman intensity between the peak P2 of the G band and the peak P3 of the 2D1 band. In the optically transparent conductive layer 22 having such Raman spectra, a constitution in which the deformation regions 31 described above are mixed can be more easily obtained, and adjustment of optical transparency and electrical conductivity is further facilitated.

In the present embodiment, when the vapor deposition time for the constituent material C is relatively short, the Raman intensity in the peak P1 of the D1 band is higher than the Raman intensity in the peak P2 of the G band. In the photocathode 4 including the optically transparent conductive layer 22 having such Raman spectra, since the thickness of the optically transparent conductive layer 22 is decreased, the photocathode 4 having excellent optical transparency can be obtained. On the other hand, when the vapor deposition time for the constituent material C is relatively long, the Raman intensity in the peak P1 of the D1 band is lower than the Raman intensity in the peak P2 of the G band. In the photocathode 4 including the optically transparent conductive layer 22 having such Raman spectra, since the thickness of the optically transparent conductive layer 22 is increased, adjustment of optical transparency and electrical conductivity is further facilitated.

In a method for manufacturing the photocathode 4 according to the present embodiment, the optically transparent conductive layer 22 is formed on the translucent substrate 21 through vapor deposition using gas including carbon. According to such a technique, in contrast to a technique in which the separately formed optically transparent conductive layer 22 is transferred onto the translucent substrate 21, the optically transparent conductive layer 22 can be easily formed through a step of simply performing vapor deposition of the constituent material C using the vapor deposition device 51. In addition, the optically transparent conductive layer 22 can be uniformly formed even when there are somewhat irregularities in the translucent substrate 21, and the stable optically transparent conductive layer 22 can be formed even when the surface area increases. In addition, the thickness or the transmittance of the optically transparent conductive layer 22 can be easily adjusted by adjusting the vapor deposition time using the vapor deposition device 51, and even when the optically transparent conductive layer 22 is provided as a base between the translucent substrate 21 and the photoelectric conversion layer 24, desired characteristics can be easily obtained.

In the present embodiment, the vapor deposition time for the constituent material C is 60 minutes or shorter. In this case, it is possible to favorably obtain the optically transparent conductive layer 22 having each of the peaks described above.

[Evaluation Test Result of Photocathode]

Figure 7:
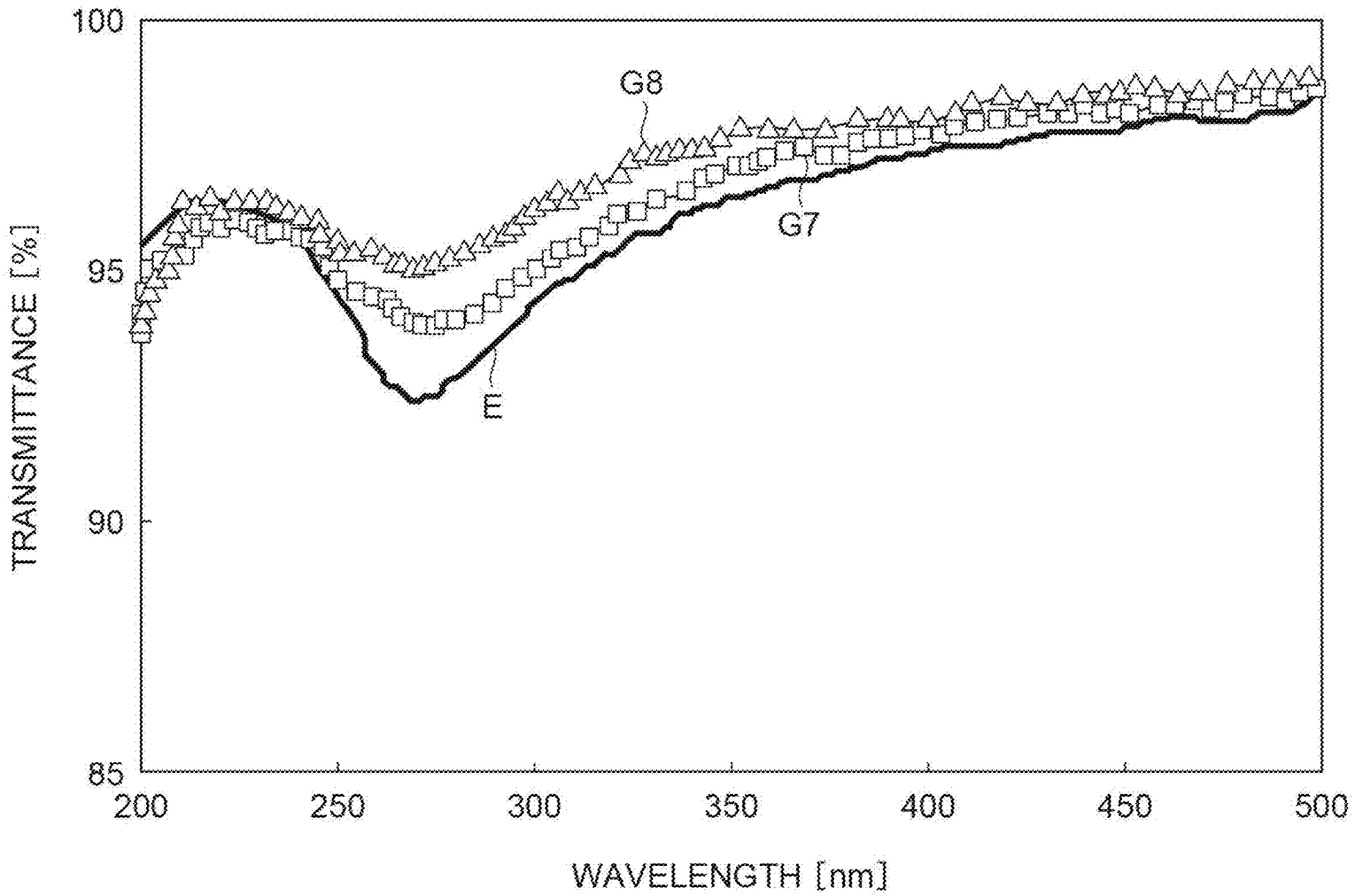
FIG. 7 is a view illustrating an evaluation test result regarding spectral sensitivity characteristics of a photocathode.

FIG. 7 is a view illustrating an evaluation test result regarding spectral sensitivity characteristics of a photocathode. In FIG. 7, the horizontal axis indicates a wavelength (nm) of incident light, and the vertical axis indicates a transmittance (%). A graph E shown in the diagram shows the transmittance of a photocathode (comparative example) constituting the optically transparent conductive layer using a graphene of a single layer, and graphs G7 and G8 shown in the diagram show the transmittance of a photocathode (Example) constituting the optically transparent conductive layer using glassy carbon. The graph G7 shows the photocathode formed by having a carbon supply raw material kept on being supplied for approximately 7 minutes, and the graph G8 shows the photocathode formed by having a carbon supply raw material kept on being supplied for approximately 8 minutes. From the results shown in FIG. 7, it can be confirmed that a photocathode in which an optically transparent conductive layer is constituted using glassy carbon exhibits a higher transmittance than a photocathode in which an optically transparent conductive layer is constituted using a graphene in a UV wavelength region of a wavelength of 230 nm to 330 nm.

Figure 8:
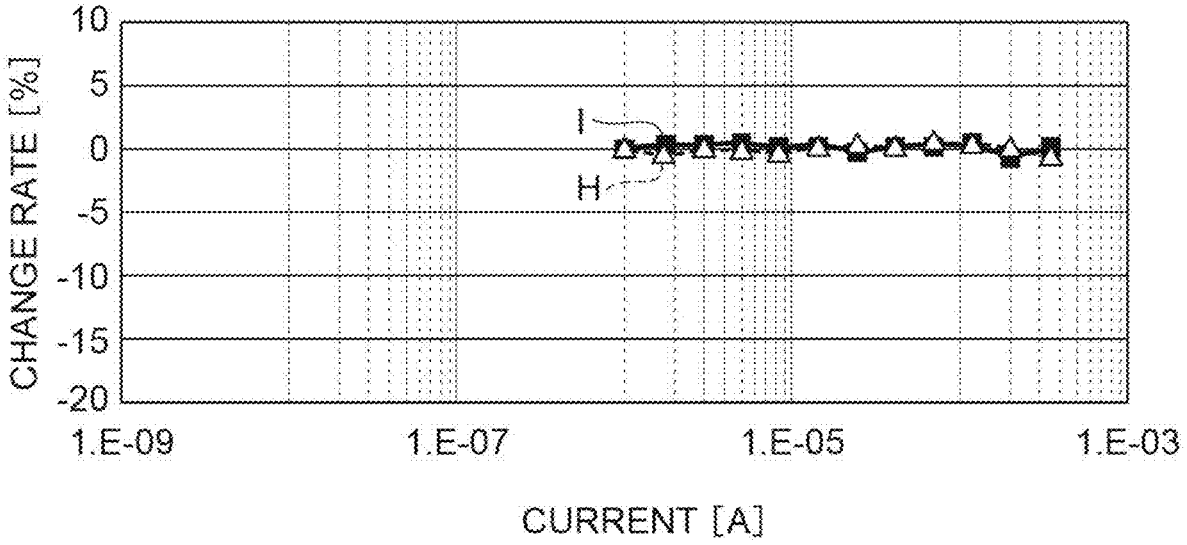
FIG. 8 is a view illustrating an evaluation test result regarding cathode linearity characteristics of a photocathode.

FIG. 8 is a view illustrating an evaluation test result regarding cathode linearity characteristics of a photocathode. In FIG. 8, the horizontal axis indicates a cathode output current value (A), and the vertical axis indicates a change rate (%) of a cathode output current value from a current value (ideal value) when ideal linearity is indicated. A graph H indicated by a dotted line in the diagram shows cathode linearity characteristics of a photocathode (comparative example) in which an optically transparent conductive layer is constituted using a graphene, and a graph I indicated by a solid line in the diagram shows cathode linearity characteristics of a photocathode (Example) in which an optically transparent conductive layer is constituted using glassy carbon. From the results shown in FIG. 8, it can be confirmed that the photocathode in which an optically transparent conductive layer is constituted using glassy carbon is also stable in the vicinity of 0% until the change rate when the current value is increased (the quantity of incident light is increased) reaches a measurement limit, and cathode linearity characteristics which are approximately the same as those in the case of a photocathode in which an optically transparent conductive layer is constituted using a graphene can be obtained.

The present disclosure is not limited to the foregoing embodiment. For example, regarding various manufacturing conditions in the method for manufacturing a photocathode, the flow rate, the time, and the like may be arbitrarily changed in accordance with the thickness of glassy carbon desired to be formed, the kind or the concentration of carbon supply raw material, or the like. In addition, a carbon supply raw material need only be gas containing carbon and may be a material other than ethanol. Examples of other carbon supply raw materials include alcohols (for example, methanol, propanol, and butanol), hydrocarbons (methane, ethane, propane, and butane), phenols, aldehydes, and ketones. In addition, vaporized gas (including those gasified through evaporation, sublimation, or dissolution of a solvent) thereof may be used.

REFERENCE SIGNS LIST

1 Photomultiplier tube
4 Photocathode
21 Translucent substrate
21*a* One surface
21*b* The other surface
22 Optically transparent conductive layer
24 Photoelectric conversion layer
51 Vapor deposition device
C Constituent material
L Incident light (light)
P1 Peak of D1 band
P2 Peak of G band
P3 Peak of 2D1 band
P4 Peak of (D1+G) band
R1 Smallest value
R2 Base value

The invention claimed is:

1. A photocathode comprising:

a translucent substrate having one surface on which light is incident and an other surface emitting the light incident through the one surface;

a photoelectric conversion layer provided on the other surface of the translucent substrate and convert the light emitted through the other surface into photoelectrons; and an optically transparent conductive layer provided between the translucent substrate and the photoelectric conversion layer, wherein the optically transparent conductive layer is formed of a constituent material including carbon, and wherein a Raman spectrum of the constituent material has
a peak of a D1 band,
a peak of a G band,
a peak of a 2D1 band, and
a peak of a (D1+G) band.

2. The photocathode according to claim 1, wherein a smallest value of a Raman intensity between the peak of the D1 band and the peak of the G band is higher than a base value of a Raman intensity between the peak of the G band and the peak of the 2D1 band.

3. The photocathode according to claim 1, wherein a Raman intensity in the peak of the D1 band is higher than a Raman intensity in the peak of the G band.

4. The photocathode according to claim 1, wherein a Raman intensity in the peak of the D1 band is lower than a Raman intensity in the peak of the G band.

5. A method for manufacturing a photocathode, wherein the photocathode according to claim 1 is manufactured, the method for manufacturing a photocathode comprising:

a step of disposing a translucent substrate inside a vapor deposition device;

a step of forming an optically transparent conductive layer by introducing gas including carbon into the vapor deposition device and performing vapor deposition of a constituent material including carbon on the translucent substrate; and a step of forming a photoelectric conversion layer on the optically transparent conductive layer.

6. The method for manufacturing a photocathode according to claim 5, wherein a vapor deposition time for the constituent material is 60 minutes or shorter.

* * * * *